US008282460B2

(12) United States Patent
Tarantino

(10) Patent No.: US 8,282,460 B2
(45) Date of Patent: Oct. 9, 2012

(54) METHOD OF PRESENTING AND PLAYING GAMES WITH ENHANCED OUTCOMES

(75) Inventor: Elia Rocco Tarantino, Las Vegas, NV (US)

(73) Assignee: American Gaming Systems, Henderson, NV (US)

( * ) Notice: Subject to any disclaimer, the term of this patent is extended or adjusted under 35 U.S.C. 154(b) by 234 days.

(21) Appl. No.: 12/317,488

(22) Filed: Dec. 22, 2008

(65) Prior Publication Data

US 2009/0176562 A1 Jul. 9, 2009

Related U.S. Application Data

(63) Continuation-in-part of application No. 11/729,092, filed on Mar. 27, 2007, now abandoned, which is a continuation-in-part of application No. 11/406,814, filed on Apr. 19, 2006, now Pat. No. 7,740,245.

(51) Int. Cl.
*A63F 9/24* (2006.01)

(52) U.S. Cl. ..... 463/13

(58) Field of Classification Search ..... 463/13, 463/16, 25; 273/292
See application file for complete search history.

(56) References Cited

U.S. PATENT DOCUMENTS

| | | | | |
|---|---|---|---|---|
| 5,356,140 | A | 10/1994 | Dabrowski et al. | |
| 5,542,669 | A | 8/1996 | Charron et al. | |
| 6,149,521 | A | 11/2000 | Sanduski | |
| 6,179,711 | B1 | 1/2001 | Yoseloff | |
| 6,569,013 | B1 | 5/2003 | Taylor | |
| 6,605,002 | B2 | 8/2003 | Baerlocher | |
| 6,638,163 | B2 * | 10/2003 | Moody | 463/13 |
| 6,669,198 | B2 | 12/2003 | Wichinsky | |
| 6,698,758 | B2 | 3/2004 | Hodge | |
| 6,729,621 | B2 * | 5/2004 | Moody | 273/292 |
| 7,022,016 | B2 | 4/2006 | Wood et al. | |
| 7,059,965 | B2 | 6/2006 | Jackson | |
| 7,156,397 | B2 | 1/2007 | Moody et al. | |
| 7,247,092 | B2 | 7/2007 | Jarvis et al. | |
| 7,316,608 | B2 | 1/2008 | Moody | |
| 7,713,118 | B2 * | 5/2010 | Roemer | 463/16 |
| 2002/0160827 | A1 | 10/2002 | Slomiany et al. | |
| 2003/0134673 | A1 | 7/2003 | Moody | |

(Continued)

OTHER PUBLICATIONS

Terry Murphy, "Midwest Casino Guide—VP Does VP in Windsor", http://www.midwestcasinoguide.com/show_article.php?article_id=17&author_id=3, © 2007, 2003, 2002, Midwest Casino Guide, 6 pages.

(Continued)

*Primary Examiner* — Masud Ahmed
(74) *Attorney, Agent, or Firm* — Weide & Miller, Ltd.

(57) ABSTRACT

A method of presenting and playing a game provides the opportunity for enhanced awards. In one embodiment, if a winning game outcome is a predetermined winning outcome, an enhanced paytable or award is activated. The enhanced paytable or award offers the player a chance for enhanced winnings in one or more subsequent games. The enhanced award may be activated when a particular winning outcome is received in a game and may then be won by repeating that winning outcome in one or more subsequent games. The award might also be won by designating the outcome before a game and then receiving that outcome during the play of the game. The enhanced award or paytable may remain in effect for a period of time or for a certain number of games, and may be triggered, be selected by a player or be selected by a casino.

19 Claims, 3 Drawing Sheets

U.S. PATENT DOCUMENTS

| | | | | |
|---|---|---|---|---|
| 2003/0207707 | A1* | 11/2003 | Slomiany et al. | 463/16 |
| 2004/0017043 | A1 | 1/2004 | Moody | |
| 2004/0102238 | A1* | 5/2004 | Taylor | 463/16 |
| 2005/0110215 | A1 | 5/2005 | Jackson | |
| 2005/0130737 | A1* | 6/2005 | Englman et al. | 463/25 |
| 2006/0019744 | A1* | 1/2006 | Roemer | 463/26 |
| 2006/0084500 | A1 | 4/2006 | Baerlocher et al. | |
| 2006/0135239 | A1 | 6/2006 | David | |
| 2006/0148557 | A1 | 7/2006 | Okada | |
| 2006/0178183 | A1 | 8/2006 | Van Asdale | |
| 2007/0135193 | A1 | 6/2007 | Nicely | |
| 2007/0218982 | A1 | 9/2007 | Baerlocher | |

OTHER PUBLICATIONS

"IGT Back It Up™ Poker", gttp://www.igt.com/GamingGroup/Games/game_detail.asp?toggle=ovr&pid=5&type_id=3349&pl=, © 2002, 2007 IGT, 2 pages.

* cited by examiner

METHOD OF PRESENTING AND PLAYING GAMES WITH ENHANCED OUTCOMES

Related Application Data

This application is a continuation-in-part of U.S. application Ser. No. 11/729,092, filed Mar. 27, 2007, now abandoned, which is a continuation-in-part of U.S. application Ser. No. 11/406,814, filed Apr. 19, 2006, now U.S. Pat. No. 7,740,245.

BACKGROUND OF THE INVENTION

1. Field of the Invention

The present invention relates to games offering opportunities for awards and, more particularly, wagering type games.

2. Related Art

Wagering games continue to increase in popularity. As such, new games continue to be developed. In general, it is desirable to develop games which are interesting to players. In some instances, the entire format of the game is changed. For example, entirely new games are sometimes developed. In other situations, existing games are modified or enhanced. Such a modification may be a change in the method of game play.

One popular game feature is the "bonus." In general, most games offer basic payout or winning award for a winning outcome. It has been found, however, that many players enjoy the opportunity to continue play or to be paid enhanced winnings. In a very common game configuration, a game defines a number of predetermined winning outcomes. For one or more of those outcomes, the player is either provided the opportunity to play a "bonus round" as part of that same game for the opportunity to win a bonus award, or is directly paid a larger award.

These award structures are still very limited in their excitement. For example, the offering of such bonuses do little to entice a player to play additional games. In addition, these bonus structures are pre-set, meaning that they are the same every time. For example, a player of a game offering a bonus level generally must obtain a particular winning set of symbols for a chance to play the bonus round. That particular set of symbols does not change. In addition, these bonuses are often known before play of the game begins. For example, when a player initiates a game, they may be informed that they will be entitled to a 2× bonus for all wins.

Thus, what is provided herein is a novel wagering game which is exciting to players and which is beneficial to casinos.

SUMMARY OF THE INVENTION

In general, the invention provides a game and method of playing there for which includes the potential for an enhanced outcome. The enhanced outcome may be selected in various ways and may comprise various combinations of indicia. Upon receiving an outcome matching the enhanced outcome the player may be awarded an award which is enhanced for that outcome over a normal or base award for that outcome. The invention thus increases player excitement and encourages players to play.

In one embodiment, the method of presenting a game comprises accepting a wager for playing the game, defining a base awards associated with winning outcomes of the game, selecting at least one of the winning outcomes to comprise enhanced outcomes having an enhanced awards greater than the base award there for, presenting the game to a player, and determining if an outcome of the game is a winning outcome. If the outcome is not a winning outcome the game may be concluded. If the outcome is awarding the base award there for, and if the outcome is an enhanced outcome, awarding the enhanced award.

An enhanced outcome may be activated at various times. For example, an enhanced outcome might be selected by a player from the group of winning outcomes before a game is played. In other embodiment, the enhanced outcome might be randomly pre-selected before each game. The enhanced outcome might be selected and remain in effect for a period of time, such as a "hand of the day".

One or more embodiments may include a progressive jackpot. For example, at least a portion of the wager may be used to fund a progressive jackpot. If a player is entitled to an additional award for receiving an enhanced outcome, the additional award may then be paid from funds from the progressive jackpot.

In one embodiment, a method of presenting a plurality of games is provided. This method may comprise accepting a wager from a player, presenting a game to the player and awarding winnings for winning outcomes. If a winning outcome is received and it is a predetermined outcome, that outcome may be designated an enhanced winning outcome having an enhanced award greater than a normal or base award there for, if that enhanced outcome is received in one or more subsequent games. For example, the player may be given five subsequent games within which to repeat or receive the enhanced winning outcome. In one embodiment, the player may be permitted to elect to accept or reject implementation of the enhanced winning outcome. Alternatively, the player may be given the chance to exchange the enhanced winning outcome for another enhanced winning outcome if the player receives a different winning outcome in the subsequent games.

As with the above, the at least one enhanced outcome may be deactivated at various times. For example, the at least one enhanced outcome may be deactivated after a predetermined number of the additional games. The at least one enhanced outcome may be deactivated after the additional award is awarded. In a "hand of the day" embodiment, the at least one enhanced outcome may be activated and deactivated within a single day. It is noted that the at least one enhanced outcome may be changed every day in a "hand of the day" embodiment.

Enhanced outcomes may be activated at various times as well. In one embodiment, the at least one enhanced outcome is activated when the player logs in to a player tracking system. In another embodiment, the at least one enhanced outcome is activated when the player receives a specified outcome. In yet another embodiment, the at least one enhanced outcome is activated when the player receives a winning outcome. It is contemplated that, in gaming machines with a player tracking system, the at least one enhanced outcome may be saved to a player tracking account. In these embodiments, activating the at least one enhanced outcome may comprise activating the at least one enhanced outcome saved in a player's player tracking account.

When used with a player tracking system, the method may comprise accepting a player tracking card from the player and selecting the at least one enhanced outcome from one or more enhanced outcomes saved in a player tracking account. In some embodiments, the method may also comprise logging in the player to a player tracking system when the player inserts a player tracking card, and logging out the player when the player removes the player tracking card. In these embodiments, the at least one enhanced outcome may be activated when the player is logged in and may be deactivated when the player is logged out.

The base awards for winning outcomes may comprise monies, credits or the like. Enhanced awards may comprise multipliers or increased monies or credits above the base award for a winning outcome. In one embodiment, one or more progressive jackpots are provided which grow over time. The enhanced awards may comprise all or a portion of a progressive jackpots. Progressive jackpots may be associated with particular outcomes and be eligible to be won when the outcome is designated as an enhanced winning outcome.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE PREFERRED EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention comprises methods of presenting and playing games. One aspect of the invention is a wagering game offering a player an opportunity for winnings for one or more predetermined winning outcomes. In the event of a winning outcome, the game offers an opportunity for an enhanced award for one or more winning outcomes in one or more subsequently played games. In one embodiment, a winning outcome of a game causes one or more base or normally awarded winning values to increase or be enhanced. A player may play the game at a later time and, if a winning outcome associated with one or more of the increased awards is received, the player is awarded that increased or enhanced award.

Figure 1:
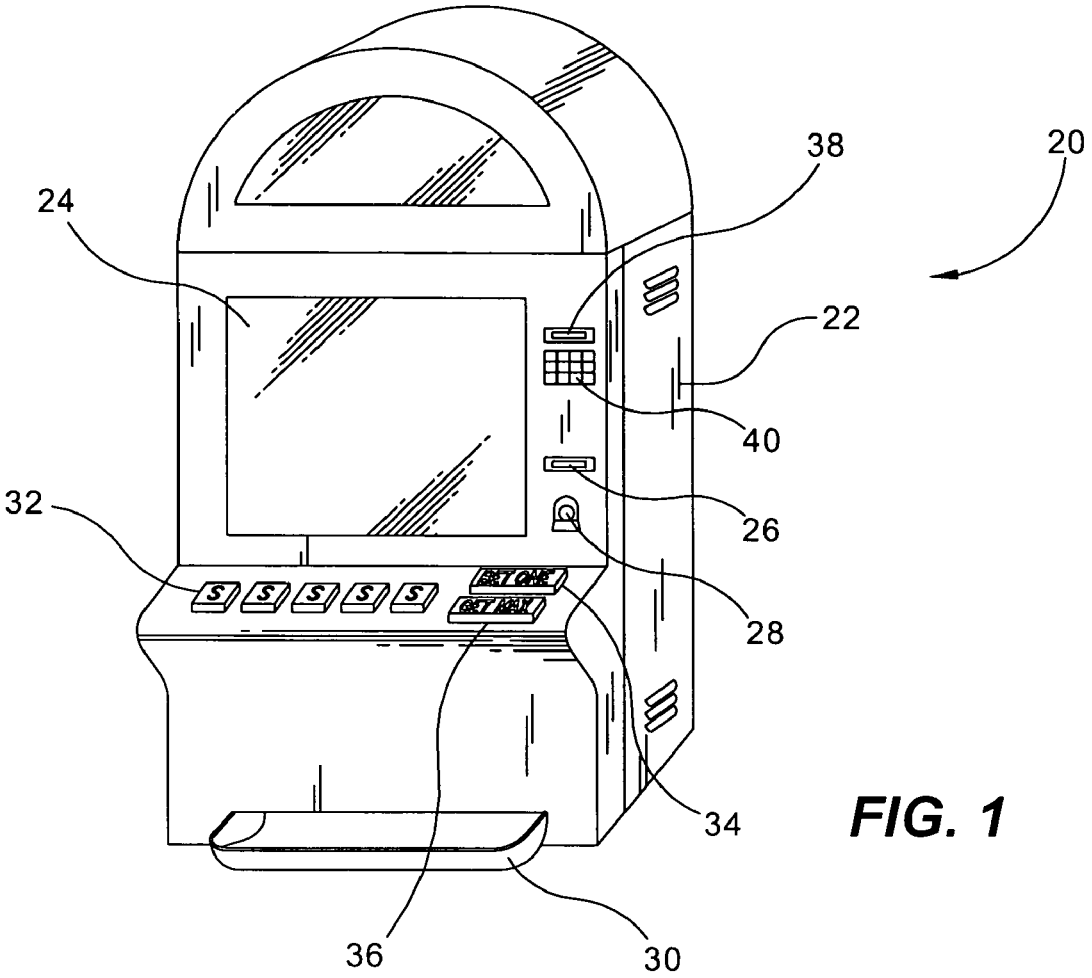
FIG. 1 illustrates an exemplary gaming machine for use in accordance with a game of the invention.

In one embodiment, the one or more games of the invention are implemented by and presented to a player with a gaming machine. FIG. 1 illustrates a gaming machine 20 in accordance with one embodiment of the invention. As illustrated, the gaming machine 20 includes a housing 22 for enclosing/supporting various components of the gaming machine. The gaming machine 20 may include one or more display devices, such as a video display 24, for displaying game information. This information may comprise, as detailed below, images of cards or other indicia, and associated game information such as a paytable. Speakers (not shown) or other devices may be provided for generating sound associated with the game.

In one embodiment, the game is played as a wager-type game which requires that a player place a bet or wager to play the game. As illustrated, the gaming machine 20 may include one or more devices or means for accepting value, such as a bill validator/acceptor 26 for accepting paper currency and/or a coin acceptor 28 for accepting coins. Other means of accepting value for wagering, such as a credit card reader or a ticket reader, may be provided. The player may wager some or all of this value, such as by providing input regarding a wager (such as by pressing a "bet one" or "bet max" button, which effectuates placing a wager from the provided value).

Preferably, if the player is a winner of the game, then the player is provided an award. The award may comprise physical monies, such as bills or coins, or may comprise representative value, such as credits. An award of winnings in the form of coins may be paid to the player via a coin tray 30. Value may also be provided to the player by a printed receipt, a card or the like, as is well known in the art of "cashless" gaming.

Preferably, the gaming machine 20 includes means for a player to provide input. In one embodiment, this means comprises one or more buttons. For example, a plurality of card "hold" or "select" buttons 32 may be provided for permitting a player to hold/select cards in a hand. A deal/draw button 34 permits a player to indicate that they wish the game to start or to draw replacement cards. A bet button 36 is provided for a player to select the amount to bet on a particular game. Other or additional types of input devices may be utilized, such as a touch-screen, joystick, rotating arm or the like.

A game controller (not shown) is provided for controlling the various devices of the gaming machine and for providing game information. For example, the game controller may be arranged to generate video and audio data for presentation by the display 24 and speakers of the gaming machine 20. The game controller may be arranged to detect a signal from the coin acceptor indicating the receipt of coins or other value, and may be arranged to cause a coin delivery mechanism to deliver coins from a coin hopper to the coin tray 30, or otherwise credit or dispense winnings. The controller may also be configured to detect the placing of a wager and then present a game in response thereto. The game controller may be configured to accept game data generated at a remote location, such as a remote server, and effect presentation of a game using that data.

It will be appreciated that the gaming machine 20 may have a variety of configurations and the gaming machine 20 illustrated and described above is but an example of a device for implementing the game of the present invention. For example, the gaming machine 20 may include one or more rotating reels, as is common to "slot"-type machines. The gaming machine 20 may be associated with a network and receive game information remotely and may transmit information, such as payout and game play information, to a remote location. Such a network may include one or more wireless or wired communication links.

The gaming machine 20 may also have other forms than that illustrated. For example, the gaming machine 20 might comprise a computing device, such as a home computer. The home computer may be configured to receive game information over the Internet or other communication link to a game server. The gaming machine 20 might also comprise a handheld device such as a mobile telephone or PDA.

As will be appreciated later, the game of the invention may also be presented via other than a gaming machine. For example, the game may be presented as a "table" game.

One aspect of the invention comprises methods of playing or presenting games. One embodiment of a method of presenting a game will be described with reference to FIG. 2.

As indicated above, in a preferred embodiment, a game of the invention is a wagering type game. As such, in a step S1, the game preferably includes the step of accepting a wager. The wager may be accepted from a player. In one embodiment, the step of accepting a wager comprises two components. First, a player provides value. Second, the player designates a portion of that value to comprise a wager. For example, a player my provide coins, bills, a value ticket or other value or source of value. In the case of a gaming machine, that value or source of value may be input to the machine. In the case of a gaming table, that value or source of value might be provided to a dealer. In the case of a gaming machine, the value may be represented as credits. The player may then wager some or all of those credits, such as by providing a "wager" input such as depressing a "bet one" or "bet max" button. In the case of a table game, the player value may be represented by gaming chips. The player may place a wager by transferring one or more of those chips to the game provider (such as a dealer).

In a step S2, the method preferably includes the step of determining if a base or enhanced paytable or award structure is in effect. If not, then a basic paytable is preferably utilized, as in step S3. If so, then in a step S4, it is determined if that paytable or award structure is to remain in effect. If not, then the base paytable or award structure is preferably utilized. If so, then the enhanced paytable or award structure is utilized, as in step S5.

In one embodiment, as detailed below, the criteria for determining whether an enhanced paytable or award structure remains in effect may vary. For example, such criteria may depend upon the number of games played after a particular enhanced paytable or award structure is placed into effect or the outcome of one or more games.

Regardless of which paytable or award structure is utilized (i.e. in steps S3 or S5), in a step S6, a game is presented to one or more players. The game may be of a variety of types. For example, the game may be a video-poker game, a slot-type game, a table game such as poker or blackjack, or other games now known or later developed. The presentation of the game may include the presentation of game information, such as the display of video-generated card images, the rotating of reels to display slot indicia, the dealing of physical cards or the like. The presentation of the game may alternatively or, in addition, comprise the acceptance of various inputs from the player(s). For example, a player may press a "deal" button of a gaming machine to cause cards to be displayed, and may press one or more "hold/draw" buttons to cause cards to be replaced (as in the case of "draw" type poker).

Preferably, the game presented to the player has at least two outcomes. One or more, but preferably not all, of those outcomes are designated winning outcomes. Each winning outcome has an associated award. The awards may the same or different. In one embodiment, the awards comprise credits which are representative of monetary value.

In a step S6, the outcome of the game is determined. This preferably comprises determining whether the outcome of the game is one of the predetermined winning outcomes (or is otherwise a "non-winning" or "losing" outcome). If the outcome of the game is not a winning outcome (i.e. a "losing" outcome), then the game preferably ends at step S8. In one embodiment, in such instance, the player loses or forfeits their wager.

If the outcome of the game is a winning outcome, then in a step S9, the player is preferably awarded winnings for that outcome. The winnings may be defined by a paytable of winning outcomes and associated awards. As indicated above, the particular paytable or other award structure which is in effect may vary. As also indicated above, such an award may comprise an award of credits, monies or other prizes or the like.

In a step S10, in one embodiment, it is determined if the winning outcome is a "game changing" outcome. If not, then the game ends, as in step S8. As will be appreciated in more detail below, such an outcome may be one which "deactivates" an enhanced paytable or award structure, or one which causes an enhance paytable or award structure to be implemented.

In step S11, it is determined if the winning outcome is "gaming changing", then it is determined if an enhanced paytable or award structure is in effect. If so, then in step S12, a change is preferably made back to the base paytable or award structure. If not, then a change is preferably made to the enhanced pay table or award structure, as in step S13.

Thereafter, the game preferably ends, as in step S8.

It will be appreciated that the above-referenced description represents one embodiment of a game. The game may have other features and may be implemented in other fashions. For example, the game may be implemented using a "flow" or logic which differs from that detailed above.

Some particular examples of methods of presenting and playing games in accordance with the invention will now be described. These examples will provide additional insight into various aspects of the invention.

Figure 3:
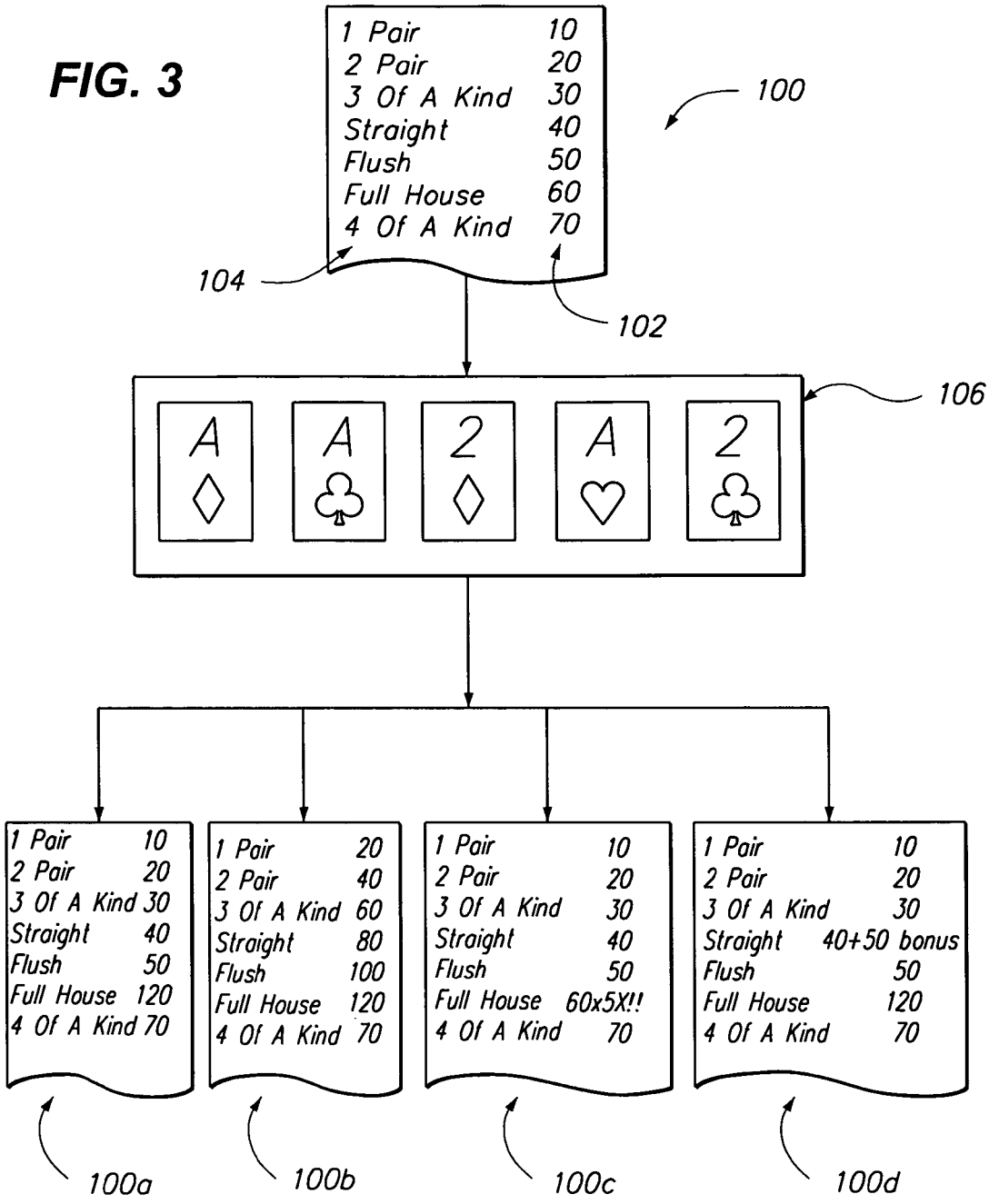
FIG. 3 illustrates an example of a base paytable or award structure, a particular game outcome and a variety of enhanced paytables or award structures which may be yielded in accordance with a game of the invention.

Referring to FIG. 3, in one embodiment, a game may have a base paytable or award structure 100. In the case of a video poker game, the paytable may provide for the award of winnings 102 for various predetermined winning poker hands 104. As illustrated, such hands or outcomes 104 might comprise "one pair" (such as a pair of Jacks or better), "two pair", "three of a kind" and the like. Of course, the particular outcomes which are designated as winning may vary, such as depending upon the particular game which is being presented.

As illustrated, each predetermined winning outcome 104 preferably has an associated winning award 102. The award may comprise, for example, a number of credits representative of monetary value.

A player may play the game and receive an outcome 106. As detailed above, the player is preferably required to place a wager in order to the play the game. Where the game is a game of video poker, the outcome of the game may comprise a poker hand. As illustrated, the outcome is a hand of five poker cards. Of course, the outcome of the game will depend upon the particular game which is being presented.

As indicated above, if the outcome of the game is a winning outcome, then the player is preferably awarded an award. In the illustrated example, the outcome of the game is a "full house" poker hand. The player is preferably awarded 60 credits in accordance with the paytable or award structure 100 which was then in effect during play of that game.

Next, it is determined if the winning outcome is a specific or, predetermined outcome. If one embodiment, a specified outcome comprises one or more of the predetermined winning outcomes. For example, a specified outcome might comprise all winning outcomes from "one pair" up through a "full house" (thus excluding winning hands such as "four of a kind."

If so, then it is determined if the paytable or award structure is preferably changed. In one embodiment, referring to FIG. 3, in the event the base paytable or award structure is active and a specified winning outcome is received, then a different paytable or award structure is activated.

FIG. 3 illustrates various different paytables or award structures which may be activated. In a first embodiment, the new paytable or award structure 100*a* may include a different payout or award for the particular outcome which was just received. In the example provided where the outcome was a "full house" poker hand, the award for that particular outcome may be adjusted. Preferably, the adjustment is an increase in the size or value of the award. In a most preferred embodiment, the increase is at least a doubling of the award. For example, where the base award was 60 credits for "full house", the new award may be 120 credits.

In another embodiment, the new paytable or award structure 100*b* may include different payouts or awards for various outcomes. In one embodiment, the award associated with the outcome just received and all others of lesser rank or award than that just received may be adjusted. In the example provided where the outcome was a "full house" then the awards associated with that outcome and all other winning hands of lower ranks are adjusted. Preferably, the adjustment is an increase and most preferably an increase of at least two times the original or base award. In one embodiment the amount by which the particular awards are adjusted need not be the same.

It will be appreciated that different "rules" may apply to the particular specific outcomes. For example, when one particular specified outcome is received, it may be that the new paytable or award is adjusted only as to that particular award. However, if another specified award is received, the paytable or award structure may be adjusted as to awards associated with multiple different outcomes.

The paytable or award structure may be adjusted in a variety of ways. In one embodiment, the particular award values may be changed. Referring to FIG. 3, in one embodiment the base award value may remain the same but the paytable or award structure 100*c* may include a multiplier. The multiplier may apply to a particular award or multiple awards. Still referring to FIG. 3, in one embodiment the base award value may remain the same but the paytable or award structure 100*d* may include one or more bonus amounts or values. Again, the bonus value or values may apply to a particular award or multiple awards.

It will be appreciated that the paytables or awards need not be in a "table" form but are simply one way to illustrate that the particular award or value for one or more outcomes has been changed and that, should that outcome be received when playing a future game, the player would be awarded the corresponding "new" or enhanced amount.

In one embodiment, once a new paytable or award structure is in effect, a player has an opportunity to be awarded an award in accordance with that new paytable or award structure via later play of the game. In one embodiment, the new paytable or award structure remains in effect until the player receives a specified outcome. Preferably, once the player receives the same specified outcome which caused the new paytable or award structure to go into effect, that same specified outcome causes the base or old paytable or award structure to go back into effect, as in steps S11 and S13 of the flow diagram described above. For example, if a player received a specified winning outcome of a "full house", the player might be awarded 60 credits and the paytable or award might be changed so that the next occurrence thereof entitled the player to an award of 120 credits. Upon the next game play occurrence in which the player received another "full house" outcome, the player would be paid 120 credits and the old paytable or award structure (providing for payment of 60 credits) would go back into effect.

Figure 2:
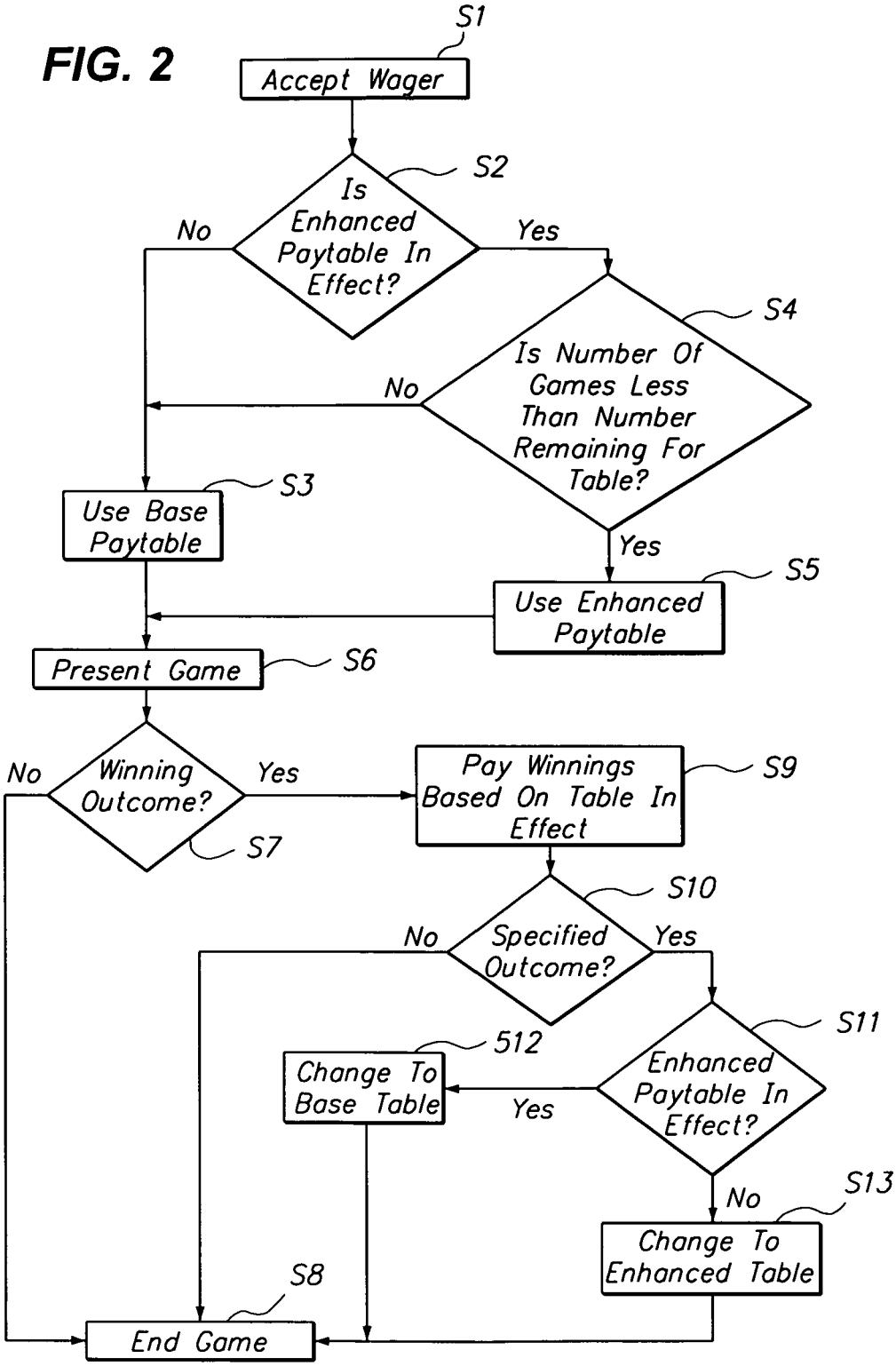
FIG. 2 is a flow diagram illustrating a method of game presentation/play in accordance with an embodiment of the invention.

In one embodiment, as detailed in step S4 of the flow diagram illustrated in FIG. 2, the game may be configured so that the new paytable or award structure remains in effect only for a certain number of subsequent games, plays or for a period of time. For example, the new paytable or award structure may remain in effect only for the next three (3) or five (5) games (or any other number of games), rather than until the specific outcome is received again. Of course, the new paytable or award structure might remain in effect only for a certain period of time or based upon other criteria. For example, if a player received a "full house" and the paytable or award structure was changed, the player might be provided only five games to receive another "full house" outcome or else the paytable or award structure would revert back to the base paytable or award structure.

Various additional features and aspects of the invention will now be described. In one embodiment the paytable or award structure may be modified in multiple ways and those modifications may "phase" in and out depending upon the specified outcomes. For example, if a player received a specified outcome such as a "full house" the paytable or award structure might be modified to that the paytable 100*c* illustrated in FIG. 3. The player might then have five games to obtain another "full house" outcome and be awarded the enhanced award (of 60 times the 5× multiplier, or 300 credits). If during the next game the player received the specified outcome of "three of a kind" (which might be a winning result entitling the player to a payout or award for that particular game) then the paytable or award structure might be further modified so that the award for the "three of a kind" outcome is doubled, so long as such outcome is received in the next five games. If the player did not receive a "full house" as a result of playing the five games after receiving that particular outcome, then the enhanced paytable or award structure associated with that particular result would "phase out", but during the next game the enhanced paytable or award structure for the "three of a kind" would still be in effect. In such a situation, the "logic" or "flow" of the game may be modified from that in FIG. 2 so that the method includes one or more steps for implementing multiple enhanced paytables or award structures, and for determining which such structures are in effect for particular games (as they may "phase out" at different times). Of course, such features may be implemented in various manners.

In other words, various enhanced paytable or award structures might overlap for one or more games. The particular enhanced paytables or award structures might be different. For example, upon receiving a particular outcome, the awards for particular outcomes might double. Upon receiving another outcome, that already enhanced paytable or award structure might be modified so that a multiplier applies to the already doubled awards.

In alternative embodiments, enhanced paytables or award structures may not overlap. In other words, only one enhanced paytable or award structure may be active at a time, such as a particular enhanced award for a particular winning outcome. In one embodiment, a player may be allowed to choose whether or not to activate an enhanced paytable or award for one or more outcomes. For example, when a triggering event that can activate an enhanced paytable or award occurs, the player may be given a choice of whether to activate the enhanced paytable or award. For example, a screen may be displayed which allows the player to choose to activate or not activate the enhanced paytable or award for one or more outcomes.

If activated, the enhanced paytable would become active and provide enhanced awards if the one or more outcomes are subsequently received. The enhanced paytable may remain in effect until deactivated such as described herein. For example, an enhanced paytable may remain in effect for a certain number of rounds or hands of a game. Also, and enhanced paytable may remain in effect until the player is awarded an enhanced award from the enhanced paytable. The enhanced paytable may also remain in effect for a set period of time.

Allowing a player to choose whether to activate the enhanced paytable for one or more outcomes provides various advantages. For example, where some outcomes are associated with lower awards, the player may choose to forego the enhanced paytable or award in the hope of playing for an enhanced paytable with higher awards. In one embodiment, the enhanced paytables may pay the player from various progressive jackpots. Thus, the player may choose to forego an enhanced paytable associated with a smaller jackpot and activate enhanced paytables associated with larger jackpots. Of course, the player may choose to activate enhanced paytables as he or she desires as well.

Another advantage of allowing a player to choose whether to activate an enhanced paytable is that the player may be locked into a particular enhanced paytable until it is deactivated by the game. This may occur in embodiments where only one enhanced paytable may be active at a time (i.e. where enhanced paytables may not overlap). Thus, a player may choose not to activate an enhanced paytable because he or she does not want to be locked in to the particular enhanced paytable which would not allow activation of more desirable enhanced paytables while the particular paytable is active.

In one embodiment, the duration of an enhanced paytable may be presented to the player to allow the player to make a more informed choice on whether to activate the paytable. For example, a screen may display the number of hands/rounds or the period of time an enhanced paytable will be active, if the player activates it. The player may then choose to forego an enhanced paytable, for example, because the awards of the enhanced paytable are too low for the amount of time the paytable would be active. This is especially advantageous to the player where only one enhanced paytable may be active at a time.

It is contemplated that the duration of an enhanced paytable may be set based on the size of the paytable's awards. For example, the enhanced paytable may have a short duration where its awards are large, and may have a long duration where its awards or small. Of course, the enhanced paytable may be set based on the size of the paytable's awards in other ways as well.

If the player chooses not to activate an enhanced award, the game may continue according to the current paytable. The player will continue to be presented opportunities to activate enhanced paytables when one or more of the game's enhanced outcomes are triggered. It is noted that, as stated above, the player may not be presented opportunities to activate other enhanced paytables while an enhanced paytable is currently active. Thus, game play and excitement is enhanced because the player must consider the consequences to one or more future hands or rounds that his or her choice will have.

As one example of this embodiment of the invention, the progressive award for a full house hand of video poker may have grown to $5000 and the progressive award for a flush hand of video poker may have just been won and reset to $1000. When a player plays a game of video poker, they may receive a flush. This might entitle the player to activate that hand as an enhanced winning outcome, whereupon if the player received another flush in a certain number of subsequent games or rounds, the player would win the $1000 jackpot. However, because the jackpot or "enhanced paytable" for that winning outcome is low, the player may instead wish to decline to activate that outcome and instead play for a full house. For example, if the player activated the flush outcome and then on the next hand received a full house, the player would not be entitled to activate the full house outcome. If, on the other hand, the player decline to activate the flush outcome and then received a full house, the player could activate the full house outcome and play for the large $5000 progressive jackpot.

In yet another embodiment, if an enhanced paytable or award is active for one or more outcomes and a player receives another triggering outcome, then the player might be permitted to "switch" and play for the subsequent outcome. As one example, a player might receive a full house and an enhanced award or paytable may go into effect, such as enhancing the award for a full house in a subsequent number of five hands. On the next hand, the player might receive a flush. The player might then either elect to continue to play for the full house outcome (for the next three hands), or might elect to instead activate the enhanced paytable or award associated with the flush hand/outcome. In such event, the player may either be given a base number of games or hands to repeat the flush outcome (to win the enhanced award), or be given the base number of hands plus the number of hands forfeited or left over that were not played for a full house. For example, in that embodiment, if a player is given a base five hands to repeat an outcome and the player had three games or hands left over to play for the full house outcome, the player might be given eight (8) games or hands to repeat the flush award.

In a preferred embodiment, a player is required to place a wager to place each subsequent or additional game. A player might be permitted to place a wager which entitles them to play a particular number of games. In other embodiments, a player might be permitted to play one or more subsequent games without a wager.

In one embodiment, a player is awarded a first winning for an outcome which triggers the enhanced award opportunity. In another embodiment, a player might only be awarded winnings for outcomes of games which do not trigger enhanced award opportunities. For example, a player might be awarded 10 credits for a "two pair" outcome of the base game when no enhanced award structure is provided. However, if a player received a "three of a kind" outcome for that same game, no first award might be awarded, and instead the player might only have the opportunity for an enhanced award in later game(s).

In one embodiment, certain outcomes of a game may be winning, and certain outcomes may comprise the predetermined or "triggering" outcomes, but these outcomes need not be the same. For example, as indicated, a "two pair" outcome might be "winning" but not trigger an enhanced award opportunity in later games, while a "full house" outcome might yield winnings and "trigger" the opportunity for an enhanced award for one or more future game outcomes.

In one embodiment, the enhanced paytable or award structure may be varied. For example, if a player is provided an opportunity to receive a specified award again during a certain number of subsequent games, the award for that outcome may change after each game in which that outcome is not received. For example, a player may receive a "full house" outcome and the paytable or award structure may be adjusted with a 5× bonus multiplier. If the player does not receive a "full house" outcome after the next game, the multiplier might be adjusted, such as reduced to "4×." In another embodiment, the size of the enhanced award may decrease (or increase) in accordance with the odds of repeating the outcome. For example, the enhanced award for repeating the outcome on the first try (i.e., first subsequent game) might pay an enhanced award of ten

(10) times the normal award. However, on the second attempt, the enhanced award might only pay eight (8) times the normal award, etc.

The multiplier or other bonus value or other paytable or award adjustment may be pre-set (such doubling awards or a 2× multiplier) or they might vary. For example, a multiplier might be randomly generated and applied to an award. The particular award adjustments also need not be the same. For example, one award might be doubled or subject to a multiplier of 5×, while another award might be tripled or subject to a multiplier of 2×. The multiplier, bonus awards or the like might be part of game play. For example, in the play of video poker, one or more multiplier or bonus cards might be used. If one of those cards are dealt or selected, the associated multiplier or bonus might be applied.

In one embodiment, the enhanced award might comprise a secondary game, such as a free game which may yield a bonus payout. In one embodiment, the enhanced award structure might comprise larger awards for certain outcomes and reduced or no awards for other outcomes, or by increasing the number of winning outcomes (such as by making some otherwise non-winning outcomes winning outcomes for one or more future games). For example, upon receiving a specified "full house" outcome, the awards for all winning outcomes with a lower rank may be reduced by 50%, but the award for a "full house" may then be increased, such as by doubling or tripling it.

In one embodiment, the specified outcome may comprise a variety of events. Relative to a video poker game, the specified outcome which results in an enhanced award structure may comprise other than a traditional poker hand. For example, a player may receive a particular set of cards, such as cards with the values 2, 4, 6, 8 and 10 in the five card positions. Then if the player receives that same set of cards in the next game or games, the player might be awarded an enhanced award. Similarly, a specified outcome may comprise a combination of slot symbols which is otherwise not a winning set of symbols but which, if received, triggers and opportunity for an enhanced award in the next game or games.

The "enhanced" awards may be funded in various manners. In one embodiment, a player may be required to place a minimum wager in order for the above-described game feature to be enabled. For example, a player might place a single credit wager to play video poker. The player might be given the opportunity for the enhanced paytable or award structure if they place a five credit wager. In such an embodiment, the paytable for the base game may be modified to fund the enhanced award(s). For example, the payout for a winning "two pair" hand in regular video poker is two times (i.e. 2×) the wager. In accordance with the invention, the paytable of winnings for the base game may be modified to provide a payout equal to the wager (i.e. 1×) for winning "two pair" hands. In this manner, the average payout on the base award structure is reduced by 12%. This amount can be allocated to a pool for funding the enhanced awards or winnings.

In another embodiment, a player might be required to place an additional or separate wager in order to activate the enhanced award feature. All or a portion of the additional wager may be utilized to fund the enhanced awards or winnings. For example, a player may play the base game by placing a wager of between one and five credits. If the player places an additional (or 6th) credit wager, one or more of the enhanced award features described herein may be activated.

In one embodiment, the additional wager may entitle a player to participate relative to all potential enhanced awards. For example, if a player places the extra wager, the player may "activate" all potential triggering or predetermined outcomes or, such as "three of a kind", "full house", etc. In another embodiment, a player may be required to place a particular wager to activate a particular triggering outcome and associated enhanced award. For example, a player may be required to place a five (5) credit wager to play the base game, and a 6th credit wager to activate the "two pair" triggering outcome, a 7th credit wager to additionally activate the "three of a kind" triggering outcome, an 8th credit wager to additionally activate the "straight" triggering outcome, a 9th credit wager to additionally activate the "flush" triggering outcome, and a 10th credit wager to additionally activate the "full house" triggering outcome. Thus, for example, if a player placed an 8 credit wager and received a "flush" outcome, that outcome would not trigger the potential for an enhanced future award or winning.

In one embodiment, the additional wager(s) may be pooled and all enhanced awards may be funded from that pool. In another embodiment, separate pools may be created corresponding to the different triggering outcomes. For example, a "two pair" pool may be created from the 6th credit wagers, a "three of a kind" pool from the 7th credit wagers, and the like. In yet another variation, the one or more pools may be utilized to create a "progressive" enhanced award. For example, the 6th credit wagers for the "two pair" pool may fund a progressive pool that grows over time if a player does not win that pool. The progressive may be funded to a minimum level, such as 100 credits, so that the pool never drops below that amount. In such an example, wagers at one gaming machine or linked gaming machines may be utilized to fund the pools. The "two pair" pool might be at $4510.50. If a player at a first machine obtains a "two pair" outcome, then that player may be given five (5) additional attempts to obtain another "two pair" outcome. In that event, the player wins that pool. However, if a player at another machine obtains the same repeat result before the first player, the second player may be awarded the pool.

In order to attract players, the progressive or other enhanced award may be increased over time. As indicated, this may be done by simply allocating a portion of one or more wagers to the enhanced award, such as to a pool. However, the award might be increased separately or for other reasons. For example, relative to the above-referenced example in which five (5) additional credit wagers are needed to "activate" the "full house" outcome, assume that few players are placing additional wagers of more than two (2) credits. As such, the progressive or other enhanced award for the "full house" outcome may not be growing. After a certain period of time, portions of wagers might be assigned to the progressive or other enhanced award for the "full house" outcome so that it becomes larger, enticing players to place sufficiently high wagers to attempt to activate and then win that award.

In other embodiments, the progressive or other enhanced awards may be re-distributed over time so that they do not become too uneven. For example, at certain predetermined times or based upon differentials in pool sizes or other criteria, the enhanced awards may be redistributed. As one example, the "full house" pool might have grown to $10,000 while the "two pair" pool is only $100. A portion of the "full house" pool might be allocated to the "two pair" pool to increase the repeat award for "two pair" on one or more occasions.

A player might also be permitted to win all of the enhanced awards, such as the progressive jackpot or pool associated with each outcome. For example, if a player placed the maximum wager and received one of the triggering hands (such as a "full house") and within the required number of additional games received a special hand or card or other outcome (such as A, 2, A, 2, A, in that order), the player might be entitled to the enhanced award for all outcomes.

A player might also be permitted to allocate specific wagers to particular triggering outcomes. For example, a player might place a 6th and a 7th additional wager relative to "three of a kind." In that event, the enhanced award for repeating that outcome may be larger. For example, assuming that the player is entitled to a 100 credit enhanced award for repeating the "three of a kind" outcome when that outcome is triggered with a single additional credit wager, the player may be entitled to a 200 credit enhanced award if the outcome is repeated when it was initially triggered with a two additional credit wager. If the enhanced paytable or award structure is activated with a wager of a certain size (such as two additional credits), then the player may be required to have placed that same size wager in order to collect the enhanced award. Otherwise, the player may be paid a lesser enhanced award. For example, if the player places a two additional credit wager and hits a "three of a kind" and then on the next hand hits a "three of a kind" again having only placed a single additional credit wager, then the player may not be paid a double award, but only a portion thereof.

In one embodiment, the enhanced award may be very large for an exact repeat. For example, a triggering outcome may be "three of a kind." If a player received the 4 of Hearts, 4 of Diamonds and 4 of Spades to activate the enhanced award structure and then received the exact same "three of a kind" card combination, the player might be awarded a much higher enhanced award than for other three of a kind card combinations. Again, the manner by which these awards are determined and financed may vary.

In one embodiment, if a particular trigger card or triggering outcome or event is received or occurs, it may increment the enhanced award or bonus relative to one or more of the outcomes. For example, each time the Ace of Spades is received, it may increment or increase the progressive bonus or other enhanced award associated with a repeat outcome of a "three of a kind".

In one embodiment, a player's opportunity for an enhanced award may depend on other criteria, such as whether they are using a player tracking system associated with a gaming machine. Such systems are well known and have applicability to both gaming machines and table games.

As described above, an enhanced paytable or award structure may be applied to any future games. Thus, a first player might play a game which causes the enhanced paytable or award structure to go into effect. If that player leaves the gaming machine, table or the like, a second player may then have the opportunity to play subsequent games with the opportunity to win the enhanced award(s).

In another embodiment, an enhanced pay table or award structure is associated with a particular player. For example, a player may log into a player tracking system (such as with a card or PIN). If an enhanced paytable or award structure is in effect, the player may stop playing and log out (such as by removing their card). The gaming machine may then reset to its base mode for the next player. When the player "logs in" again, the gaming machine may reconfigure itself to offer the enhanced paytable or award structure. Of course, such may be implemented physically at a gaming table or such may be implemented in other ways.

As indicated, the adjustment may occur only for specified outcomes. For example, a paytable or award structure adjustment might be made for video poker games with outcomes of "three of a kind" or better, but not simply "a pair" or "a pair of a Jacks or better." In another embodiment, the paytable or award structure adjustment might be made relative to as many as all of the designated winning outcomes (for example, from the normal winning outcomes of a "pair of Jacks" or better up through a "royal flush").

Game information may be displayed in a various fashions. For example, the paytable or award structure may be displayed automatically, or at least when adjusted. A multiplier or bonus value might be displayed in various fashions, such as in a manner in which the values "change" and then stop at a final applied value. Progressive or bonus enhanced awards may be shown in a table or counter, so that the player is able to see the changing value of the award.

In one embodiment, if a player receives a specified outcome, the player may be entitled to select one or more outcomes to be enhanced. The player may then be provided one or more later game opportunities to obtain the particular selected winning outcomes to win the enhanced awards associated therewith. The particular triggering outcome or outcome to be enhanced may be other than a specified winning outcome for the base game. For example, a player might be permitted to elect the card combination 2, 4, 6, 8, and 10 (of any suit) as an outcome which, if received and then received again (such as within a specified number of hands/turns), is entitled to an enhanced award.

As indicated above, in one preferred embodiment of the game, a player is required to obtain a particular triggering outcome in order to trigger an enhanced paytable or award, and then obtain a second outcome (such as a repeat of the triggering outcome) in order to win the enhanced award. In another embodiment, however, a player may be awarded an enhanced award the first time the player receives a particular outcome.

In one embodiment, before a game begins, a particular "target" outcome may be selected, which target outcome has an enhanced award (such as a larger than normal payout, a multiplier value, a progressive jackpot value or the like, as indicated above). In one embodiment, the player may be allowed to select one or more outcomes to be enhanced without first receiving a specific outcome. For example, the player may be given the opportunity to select one or more outcomes to be enhanced prior to a wagering game. The player may select an outcome to be enhanced even when the selected outcome is not a winning outcome for the underlying wagering game (for example, the outcome 3-5-7-9-Ace in video poker is not normally a winning outcome, but the player might select such a hand and enhanced award might be associated with that award, which would be won by the player if the player hit that particular hand). In a preferred embodiment, however, one or more enhanced winning outcomes are selected from normal winning outcomes. For example, a game may have a plurality of possible outcomes, one or more of which are winning outcomes having associated base or normal awards. One or more of these winning outcomes may be selected to be enhanced winning outcomes having associated enhanced awards greater than the normal or base awards there for.

While the enhanced winning outcomes might be selected by a player, in other embodiments, the particular outcome or outcomes might be randomly selected or be selected by a casino. For example, as detailed below, a casino might designate the video poker hand "straight flush" as the hand of the day.

As described above, the enhanced outcomes may remain active until an event or specified outcome occurs. For example, the outcomes may remain activated for a particular number of rounds or hands, or until at least one of the enhanced outcomes is received by the player. In one embodiment, the enhanced outcome might remain in effect for a time period, such as a day (like from 12:00 a.m. to 12:00 p.m.), a particular game session (as detailed below), or the like.

It is contemplated that the player may be allowed to cancel or deactivate his or her selected enhanced outcomes in one or more embodiments. The player may then select one or more new enhanced outcomes if allowed. In one embodiment, the player may be required to place an additional wager to cancel and re-select enhanced outcomes. In another embodiment, the player may cancel and re-select enhanced outcomes at the end of any round or hand of a wagering game without placing an additional wager. In yet another embodiment, the player may deactivate and re-select enhanced outcomes only after any existing enhanced outcomes have been deactivated in their ordinary course, such as described above. Of course, if desired, the player may deactivate enhanced outcomes and choose not to select new enhanced outcomes.

As stated, the invention may be used with player tracking devices. Thus, in one embodiment, a player may be allowed to select one or more enhanced outcomes when the player logs in (e.g. inserts a player tracking card) to a player tracking system. Of course, in a player tracking embodiment, the player may also be allowed to select enhanced outcomes at other times, such as described above. In one embodiment, the one or more enhanced outcomes may remain active as long as the player is logged in to the player tracking system. The enhanced outcomes may also be deactivated upon the occurrence of a specified outcome or event as well.

It is noted that the player may be rewarded for logging in to a player tracking system by being provided more enhanced outcomes, extending the period that enhanced outcomes are active, or both. This is advantageous in that it encourages players to utilize a gaming establishment's player tracking system.

The player may also save one or more enhanced outcomes when using a player tracking system. In this manner, the saved enhanced outcomes may automatically become activated when the player logs in regardless of which gaming machine the player is playing. Various enhanced outcomes may be saved for various types of games. For example, the player may save one or more enhanced outcomes for slot type games and one or more enhanced outcomes for card games. These various enhanced outcomes may then be appropriately activated depending on the type of game the player is playing. For example, a saved enhanced outcome comprising playing cards may be activated when a player is playing a game with card indicia such as poker or blackjack. The enhanced outcomes may be deactived on the particular machine the player is playing when the player stops playing or logs out of the player tracking system.

In one or more embodiments, saved enhanced outcomes may be saved in a player tracking account. For example, the player tracking system may include a server or the like having a storage device for storing player tracking accounts. Individual player tracking accounts may track the play and other statistics of individual players, and store information for individual players. Players may be provided a player tracking card to identify themselves to the player tracking system. It is noted that a password, PIN, or other code may be required to verify a player's identity in one or more embodiments. Once a player is identified, the player tracking system may access a player tracking account belonging to a particular player and save and retrieve enhanced outcomes to and from the player tracking account. It is noted that, in some embodiments, an enhanced outcome may be saved on a player tracking card.

Outcomes may also be enhanced in other ways. For example, one or more outcomes may be enhanced by the gaming establishment. In one embodiment, the gaming establishment selects one or more enhanced outcomes which become active as desired by the gaming establishment. This is advantageous because the gaming establishment may use its selected enhanced outcomes to further entice players to play. The gamine machine may randomly select enhanced outcomes in one or more embodiments.

In one embodiment, the gaming establishment may provide a "hand of the day" which is generally an enhanced outcome that is active for within a particular day. Players that receive an outcome matching the "hand of the day", when it is active, receive an enhanced award (which award is preferably greater than the normal award for that outcome). The "hand of the day" will generally be selected by a gaming establishment. The "hand of the day" may be selected by gaming personnel or by a device, such as a gaming machine or server, in one or more embodiments.

Of course, the gaming establishment may also implement enhanced outcomes which are active for less than or more than a day. It is contemplated that a player may be required to repeat the "hand of the day" or other gaming establishment selected enhanced outcome prior to receiving an enhanced award in some embodiments.

In addition additional enhanced outcomes may automatically be activated for a group of machines when one or more players receive a specified outcome at one of a group of gaming machines. For example, if a player receives a specified outcome at one of a bank (or other group) of machines, all players at any machine within the bank (or group) may be provided one or more additional enhanced awards.

As one example of this aspect of the invention, the award for a full house game of video poker might comprise normally comprise 35 credits. However, for a particular day or at the selection of a player, the outcome for a full house might be enhanced to 50 credits. If the player receive that outcome during the designated time (time period, number of games, etc.) then the player receives that enhanced outcome. In this configuration, because the outcome is enhanced for a time period rather than by trigger after the outcome is received, the player might receive the enhanced award multiple times (such as by receiving a full house two times in one day).

It will be appreciated that various combinations of the features or principals described above may be utilized. In such circumstances, the method of game presentation may vary from that illustrated in FIG. 2.

Another aspect of the invention is a gaming machine, device or system which is configured to present the game of the invention. In one embodiment, the gaming machine is configured to present a game, preferably in response to a player placing a wager. A controller of the machine may either generate or accept game data and display game information via a display to the player. In the event the outcome of the game is a winning outcome, the player may be awarded an award. Preferably, the controller is then configured to present one or more additional or later games using an enhanced paytable or award structure, in the manner described above. Multiple machines may be linked and associated with common progressive pools.

As also indicated above, the method of the invention may be implemented at a gaming table. For example, a game of poker may be presented to a player using physical cards. The method of play may follow that detailed above. Various aspects of the invention may be applied to other games. For example, the principles of the invention might be applied to other card games (such as Blackjack) or other games such as slots. As one example, a player might play a base game of slots and obtain a particular winning outcome such as 7-7-7. If the player repeats that outcome in a certain number of turns or games, the player may be entitled to an enhanced award (i.e. greater than the base award) for that outcome. Similarly, a player might be entitled to an enhanced award for receiving a Blackjack (A/J) combination in repeat fashion while playing such a game.

A number of aspects of the invention will now be appreciated. The game of the invention offers heightened player excitement. If the player receives a winning outcome, the player is not only awarded an award or winnings, but the player may be offered the opportunity to win a larger award in the future. The player is then enticed to play additional games in an attempt to obtain the one or more outcomes having enhanced awards.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A method of presenting a game at an electronically controlled gaming machine comprising the machine implemented steps of:

designating a plurality of winning outcomes from possible outcomes for said game, each base winning outcome having a base award and an enhanced award;

accepting a wager from a player;

for each instance of said game, regardless of a size of said wager placed by said player, accepting input from said player of one of said winning outcomes to comprise a target outcome; and after accepting said input from said player, presenting said game to said player to generate an outcome of said game, wherein:

if said outcome is not one of said winning outcomes or said target outcome, concluding said game;

if said outcome is a winning outcome which has not been selected as said target outcome, then awarding said base award therefor to said player; and if said outcome is said target outcome, then awarding said enhanced award therefor to said player.

2. The method of claim 1 further comprising funding a progressive jackpot with at least a portion of said wager, wherein said enhanced award comprises at least a portion of said progressive jackpot.

3. The method of claim 1 wherein said step of accepting input from said player comprises:

displaying information identifying said one or more winning outcomes and said enhanced awards for use by said player in selecting a target outcome.

4. The method of claim 3 wherein said information is displayed by an electronic display of said gaming machine and said step of accepting input comprises detecting a touch-input to said display.

5. The method of claim 1 wherein said game comprises a game of poker and said winning outcomes comprise one or more designated poker hands.

6. The method of claim 3 wherein said step of accepting input comprises receiving a selection from said player of at least one of said designated poker hands.

7. A gaming machine comprising:

a housing;

at least one user input;

at least one electronic display configured to display game information to a player;

at least one information storage device;

a controller configured to receive information from said at least one user input of inputs thereto and to display game information via said at least one display to said player; and instructions stored on the storage device and executable by the controller to present a game, the one or more instructions comprising:

instructions for designating a plurality of winning outcomes from possible outcomes for said game, each base winning outcome having a base award and an enhanced award;

instructions for accepting a wager from a player;

instructions for, for each instance of said game, regardless of a size of said wager placed by said player, accepting input from said player of one of said winning outcomes to comprise a target outcome instructions for presenting said game to said player after accepting said input from said player; and instructions for determining an outcome of said game;

instructions for concluding said game if said outcome is not one of said winning outcomes or said target outcome;

instructions for awarding said base award if said outcome is one of said winning outcomes but not said target outcome; and instructions for awarding said enhanced award if said outcome is said target outcome.

8. The gaming machine in accordance with claim 7 further comprising instructions for displaying information regarding said plurality of winning outcomes via said at least one electronic display.

9. The gaming machine in accordance with claim 7 wherein said input from said player is received via said at least one user input.

10. The gaming machine in accordance with claim 9 wherein said at least one user input comprises a touch screen associated with said at least one electronic display.

11. The gaming machine in accordance with claim 7 wherein said game comprises a poker game.

12. The gaming machine in accordance with claim 11 wherein said poker game comprises a draw poker game and said gaming machine further comprises instructions for dealing a hand of cards to said player, accepting input regarding one or more cards to be discarded, and to deal a replacement card for each discarded card.

13. A computer program product for causing a gaming machine having at least one display to present a game comprising:

machine readable code stored in a tangible medium comprising:

(a) instructions to cause said gaming machine to designate a plurality of winning outcomes from possible outcomes for said game, each base winning outcome having a base award and an enhanced award;

(b) instructions to cause said gaming machine to accept a wager from a player;

(c) instructions to cause said gaming machine to, for each instance of said game, regardless of a size of said wager placed by said player, accept input from said player of one of said winning outcomes to comprise a target outcome;

(d) instructions to cause said gaming machine to present said game to said player after accepting said input from said player; and (e) instructions to cause said gaming machine to:

if said outcome is not one of said base or enhanced winning outcomes or said target outcome, said gaming machine conclude said game;

if said winning outcome is a winning outcome but not said target outcome, awards said base award therefor to said player; and if said winning outcome is said target outcome, awards said enhanced award therefor to said player.

14. The computer program product in accordance with claim 13 wherein said wager comprises designation of at least one credit to be wagered.

15. The computer program product in accordance with claim 13 wherein said game comprises a poker game.

16. The computer program product in accordance with claim 13 wherein said enhanced award comprises a progressive jackpot.

17. A method of presenting a poker game at an electronically controlled gaming machine comprising the machine implemented steps of:

displaying a pay table of winning outcomes from possible outcomes for said game, each base winning outcome comprising a poker hand having a base award and an enhanced award;

accepting a wager from a player;

for each instance of said game, regardless of a size of said wager placed by said player, accepting input from said player of one of said winning outcomes to comprise a target outcome;

after accepting said input from said player, presenting said game to said player comprising displaying one or more cards to said player and forming a poker hand;

determining an outcome of said game by evaluating said poker hand to said pay table;

if said outcome is not one of said winning outcomes or said target outcome, concluding said game;

if said outcome is a winning outcome which has not been selected as said target outcome, awarding said base award therefor; and if said outcome is said target outcome, awarding said enhanced award therefor.

18. The method of claim 1 wherein said enhanced award comprises a payout which is greater than a payout comprising said base award for said winning outcome.

19. The method of claim 1 wherein, for each winning outcome, said base award comprises a first number of credits and said enhanced award comprises a second number of credits which is greater than said first number of credits.

* * * * *

UNITED STATES PATENT AND TRADEMARK OFFICE

CERTIFICATE OF CORRECTION

PATENT NO. : 8,282,460 B2
APPLICATION NO. : 12/317488
DATED : October 9, 2012
INVENTOR(S) : Elia Rocco Tarantino It is certified that error appears in the above-identified patent and that said Letters Patent is hereby corrected as shown below:

IN THE CLAIMS:

Column 19, Lines 2-4, should read -- if said outcome is not of one of said winning outcomes or said target outcome, conclude said game; --.

Column 19, Line 6, "awards" should read -- award --.

Column 19, Line 8, "awards" should read -- award --.

Signed and Sealed this
Ninth Day of April, 2013

Teresa Stanek Rea
*Acting Director of the United States Patent and Trademark Office*